US006489867B1

(12) United States Patent
Turner et al.

(10) Patent No.: US 6,489,867 B1
(45) Date of Patent: Dec. 3, 2002

(54) SEPARATING PINS FOR THE SHUNT WIRES OF A CIRCUIT BREAKER

(75) Inventors: David Curtis Turner, Imperial, PA (US); Brian John Schaltenbrand, Cranberry Township, PA (US); Ramon Javier Ojeda, Imperial, PA (US); Ralph Mason Ennis, Imperial, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/152,967

(22) Filed: May 22, 2002

(51) Int. Cl.[7] ..... H01H 85/00; H01H 75/12; H01H 77/04; H01H 75/08; H01H 81/02

(52) U.S. Cl. ..... 335/6; 335/35; 335/43; 337/6

(58) Field of Search ..... 335/6, 8, 21, 35, 335/43; 337/6

(56) References Cited

U.S. PATENT DOCUMENTS 3,748,620 A * 7/1973 Ellsworth et al. ..... 335/176
4,620,076 A 10/1986 Mrenna et al.
5,907,461 A 5/1999 Hartzel et al.

* cited by examiner

*Primary Examiner*—Ramon M. Barbera
(74) *Attorney, Agent, or Firm*—Martin J. Moran

(57) ABSTRACT

A pair of shunt wire spacer pins provides for proper spacing between the shunt wires extending from the movable arm to the bimetal within a circuit breaker, thereby ensuring that the shunt wires do not come together during over-current conditions within the circuit breaker, and preventing the shunt wires from interfering with the movement of the trip bar.

4 Claims, 4 Drawing Sheets

SEPARATING PINS FOR THE SHUNT WIRES OF A CIRCUIT BREAKER

BACKGROUND OF THE INVENTION

1. Field of the Invention

The present invention relates to circuit breakers. More specifically, the present invention provides a pair of spacer pins for the shunt wires within the circuit breaker.

2. Description of the Related Art

A typical circuit breaker includes both a thermal trip mechanism and a magnetic trip mechanism for moving the arm having the movable contact away from the fixed contact when an over-current is present. The trip unit includes a bimetal connected at its fixed end to the load terminal, and at its free end to a shunt, which is connected to the contact arm. A trip bar mounted adjacent to the bimetal includes a thermal trip arm and a magnetic trip armature. The trip bar engages a latch on the operating mechanism for tripping the circuit breaker.

In use, current will flow from the line terminal, through the fixed contact, through the movable contact and arm, through the shunt, through the bimetal, and then through the load terminal. When a persistent low level over-current occurs, the heating of the bimetal will cause it to bend until it strikes the thermal trip arm of the trip bar, thereby tripping the circuit breaker. A larger over-current will cause the magnetic trip armature to be attracted toward the bimetal by a magnetic field generated by a short circuit current flowing through the bimetal, again rotating the trip bar and tripping the circuit breaker.

During a high interruption capacity test, it is possible for magnetic attraction caused by current flow in the same direction to cause the shunt wires to come together, thereby causing mechanical interference preventing movement of the thermal trip arm, thereby preventing tripping of the circuit breaker. Accordingly, there is a need for a means for maintaining proper spacing between the shunt wires to maintain proper function of the circuit breaker.

SUMMARY OF THE INVENTION

The present invention provides a pair of shunt wire spacer pins for maintaining the proper distance between the shunt wires within a circuit breaker. The shunt wire spacer pins depend upward from the back of the housing of the circuit breaker, extending up between the shunt wires. The shunt wire pins may be made of any suitably rigid material, such as metal or plastic.

In use, the shunt wire spacer pins depend upward from the housing wall, between the shunt wires, with each pin corresponding to one of the two shunt wires. With the shunt wire spacer pins in place, the shunt wires are held the proper distance apart to permit proper movement of the circuit breakers' thermal trip arm.

BRIEF DESCRIPTION OF THE DRAWINGS

Like reference numbers denote like elements throughout the drawings.

DETAILED DESCRIPTION

The present invention provides a shunt wire spacer pin for use with the shunt wire of a circuit breaker, thereby maintaining the proper distance between these wires to permit proper tripping of the circuit breaker.

Figure 1:
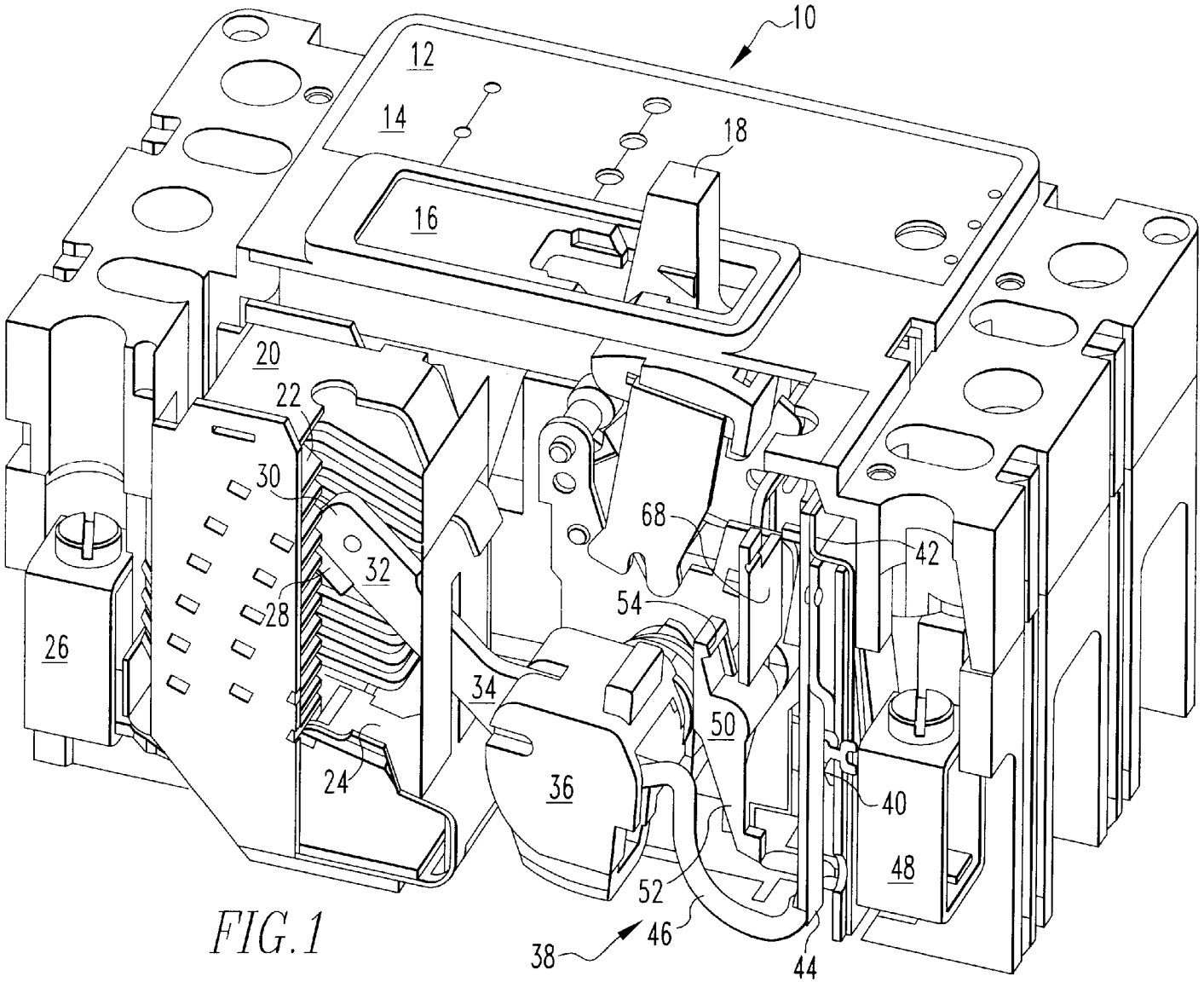
FIG. 1 is a cut-away isometric view of a circuit breaker for which the present invention will be used.
Figure 2:
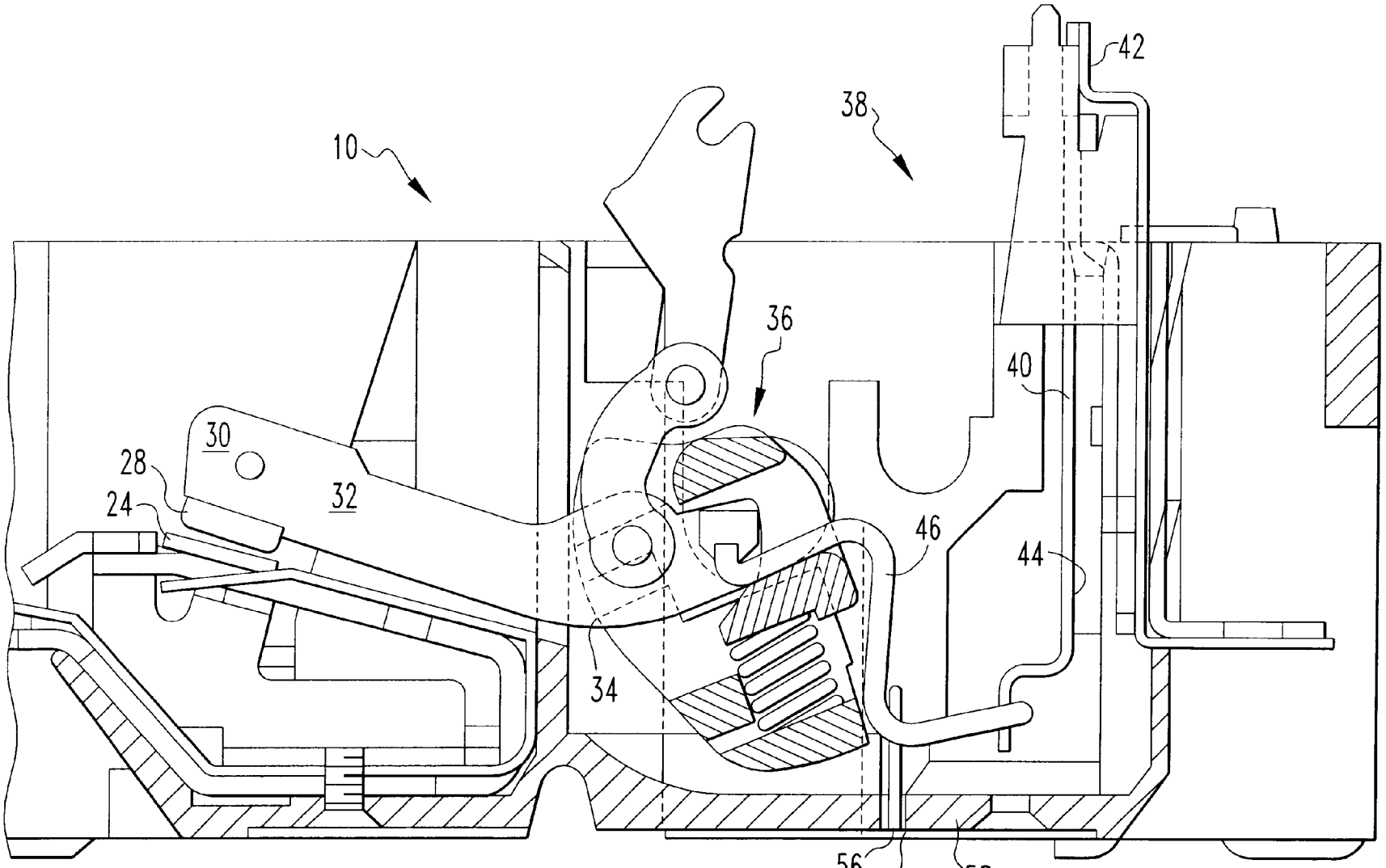
FIG. 2 is a cross-sectional side view of a circuit breaker, including a pair of shunt wire separating pins of the present invention.

FIGS. 1–2 illustrate a circuit breaker 10 with which a shunt wire spacer of the present invention may be used. The circuit breaker 10 includes a housing 12 having a front face 14. The face 14 defines an opening 16, permitting the operating handle 18 to move therein between its open and closed positions.

The interior of the housing 12 includes three identical trip mechanisms, one of which will be described herein. Each trip mechanism includes an arc chamber 20 having a plurality of substantially parallel, spaced apart plates 22. A fixed electrical contact 24 is located at one end of the arc chamber 20, and is in electrical connection with the line terminal 26. A movable contact 28 is secured to the free end 30 of the arm 32. The pivoting end 34 of the arm 32 is housed within a contact arm carrier 36, which also includes a spring therein for holding the fixed 24 and movable 28 contacts together against the magnetic forces generated by the current flowing in opposite directions through these contacts. The operating handle 18 is operatively connected to the contact arm carrier 36, so that pivoting of the contact arm carrier 36 between the open position of the movable contact 28 (illustrated in FIG. 1) and the closed position of the movable contact 28 (illustrated in FIG. 2) may be controlled using the operating handle 18.

The circuit breaker includes a thermal-magnetic trip unit 38 for separating the contacts 24, 28 in response to an overcurrent. The thermal-magnetic trip unit 38 includes a bimetal 40 having a fixed end 42, and a free end 44. A pair of shunt wires 46 provide for electrical connection between the pivoting end 34 of the arm 32, and the free end 44 of the bimetal 40. The fixed end 42 of the bimetal 40 is electrically connected to the load terminal 48. When the circuit breaker 10 is closed, current may thereby flow through the line terminal 26, fixed contact 24, movable contact 28, arm 32, shunt wires 46, bimetal 40, and load terminal 48. A pivotally mounted trip bar 50 is also within the thermal magnetic trip unit 38, adjacent to the bimetal 40. The trip bar 50 includes a thermal trip arm 52, depending substantially perpendicular to the trip bar 50, and substantially parallel to the bimetal, and a magnetic trip armature 54, which in many preferred embodiments will be substantially parallel to the thermal trip arm 52. Both the thermal trip arm 52 and magnetic trip armature 54 are positioned adjacent to the bimetal 40. A persistent low level overcurrent within the bimetal 40 will cause the bimetal 40 to bend until it engages the thermal trip arm 52. A larger overcurrent will cause a magnetic attraction between the bimetal and the magnetic trip armature 54, thereby instantly rotating the trip bar 50 to bring the armature 54 toward the bimetal 40. It is well known in the art of circuit breakers that rotation of the trip bar 50 will release a latch that will permit the arm 32 and carrier 36 to be instantly spring-biased away from the fixed contact 24, thereby opening the circuit breaker. Additionally, the current flow in the fixed contact 24 and movable contact 28, being in opposite directions, will generate opposing magnetic forces sufficiently strong to overcome the spring within the carrier 36, causing the arm 32 to pivot with respect to the carrier 36, possibly before the pivoting of the carrier 36 would open the circuit breaker.

Figure 3:
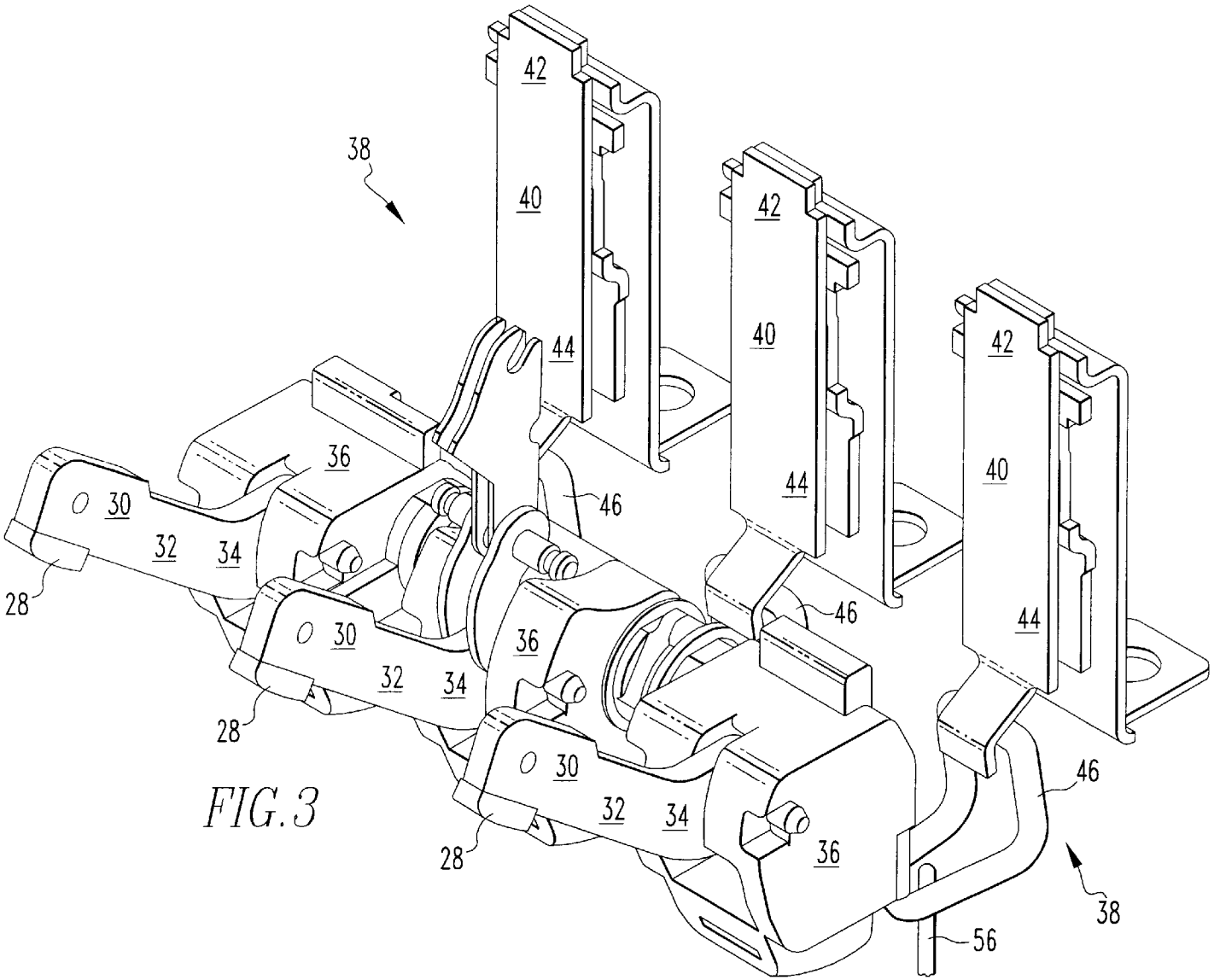
FIG. 3 is an isometric view of three contact arm carriers and their associated contact arms, shunt wires, bimetals, and shunt wire spacer pins, according to the present invention.
Figure 4:
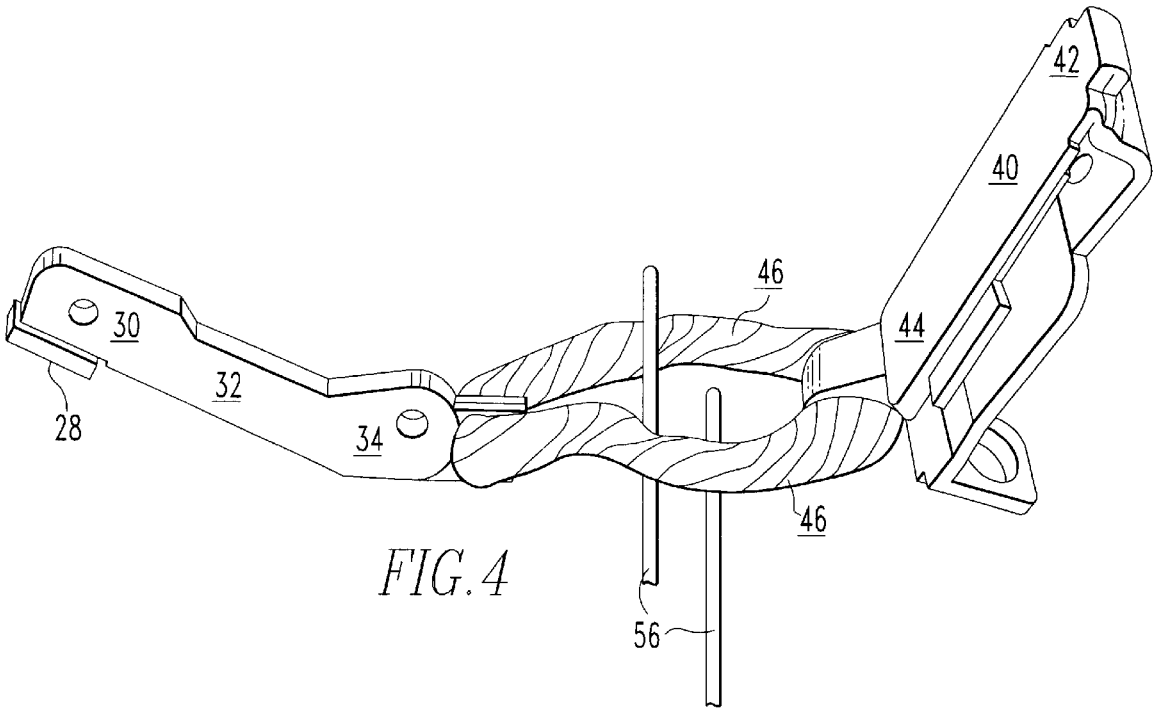
FIG. 4 is an isometric view of a movable contact arm, bimetal, connecting shunt wires, and shunt wire spacer pins according to the present invention.

During a high interruption capacity test, it is possible for magnetic attraction caused by current flow in the same direction to cause the shunt wires to come together, thereby causing mechanical interference preventing movement of the thermal trip arm 52, thereby preventing proper tripping of the circuit breaker. Accordingly, the present invention provides a pair of shunt wire spacer pins 56, extending between the shunt wires 46. As illustrated in FIGS. 2–4, with each shunt wire spacer pin 56 abutting one of the two shunt wires 46.

Each shunt wire spacer pin depends upward from the back 58 of the housing 12, extending between the shunt wires 46. The pins 56 may be made of any suitably rigid material, such as plastics, polymers, molded resin and metal. A method of assembling the circuit breaker 10 includes providing an aperture 60 within the back 58 of the housing 12, and inserting the pin 56 into the aperture 60.

With the shunt wire spacer pins 56 in place, the shunt wires 46 will be held in the proper position throughout use of the circuit breaker 10. When current is passed through the wires, causing magnetic attraction between them, they will not tend to be drawn together, as they would without the shunt wire spacer pins 56. Therefore, the shunt wires 46 will not interfere with the movement of the thermal trip arm 52 between its opened and closed positions.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker, comprising:

a housing;

a movable contact arm having an electrical contact at a first end and being pivotally secured at a second end;

a bimetal having a fixed end and a free end;

a pair of shunt wires extending between said second end of said movable contact arm and said free end of said bimetal;

a pair of shunt wire spacing pins extending from said housing to a position between said shunt wires, each of said shunt wire spacer pins abutting one shunt wire, said shunt wire spacing pins being dimensioned and configured to resist a magnetic force tending to draw said shunt wires together.

2. The circuit breaker according to claim 1, wherein said shunt wire spacer pins are secured within an aperture defined within said housing.

3. The circuit breaker according to claim 1, wherein said shunt wire spacer pins are made from a material selected from the group consisting of plastic, polymer, molded resin, and metal.

4. A method of assembling a circuit breaker, comprising:

providing a housing;

providing a movable contact arm having an electrical contact at a first end and being pivotally secured at a second end, within said housing;

providing a bimetal having a fixed end and a free end, within said housing;

providing a pair of shunt wires extending between said second end of said movable contact arm and said free end of said bimetal, within said housing;

providing a pair of shunt wire spacing pins extending from said housing to a position between said shunt wires, each of said shunt wire spacer pins abutting one shunt wire, said shunt wire spacing pins being dimensioned and configured to hold said shunt wires a desired distance apart.

* * * * *